US005462239A

United States Patent [19]

Klee et al.

[11] Patent Number: 5,462,239

[45] Date of Patent: Oct. 31, 1995

[54] METHOD AND APPARATUS FOR WINDING A YARN ONTO A BOBBIN TUBE

[75] Inventors: Werner Klee, Seuzach; Thomas Gisel, Thun, both of Switzerland

[73] Assignee: Maschinenfabrik Rieter AG, Winterthur, Switzerland

[21] Appl. No.: 96,015

[22] Filed: Jul. 22, 1993

[30] Foreign Application Priority Data

Jul. 23, 1992 [CH] Switzerland ..... 02332/92

[51] Int. Cl.[6] ..... B65H 54/42; B65H 54/02

[52] U.S. Cl. ..... 242/18 R; 242/18 DD

[58] Field of Search ..... 242/18 R, 18 DD

[56] References Cited

U.S. PATENT DOCUMENTS

| | | | |
|---|---|---|---|
| 4,069,985 | 1/1978 | Lohest et al. | 242/18 DD X |
| 4,404,501 | 9/1983 | Krampe et al. | 242/18 DD X |
| 4,548,366 | 10/1985 | Wirz et al. | 242/18 DD |
| 4,765,552 | 8/1988 | Sugioka et al. | 242/18 R |
| 4,964,582 | 10/1990 | Hermanns et al. | 242/18 R X |

FOREIGN PATENT DOCUMENTS

| | | | |
|---|---|---|---|
| 3002035 | 7/1980 | Germany | 242/18 DD |
| 2037336 | 7/1980 | United Kingdom | 242/18 DD |

*Primary Examiner*—Daniel P. Stodola
*Assistant Examiner*—William Stryjewki
*Attorney, Agent, or Firm*—McAulay Fisher Nissen Goldberg & Kiel

[57] ABSTRACT

During the run-up of a bobbin winding machine with a gap between the contact roller and the bobbin tube on a chuck, a disturbance in the speed (VTW) of the contact roller caused by the contact of the bobbin package on the bobbin tube with the contact roller is used for instantly switching on a controller for the speed control of the speed of the chuck. The time (t1), the direction as well as the magnitude of the change in speed of the contact roller during the contact are used for correcting the speed ramp of the chuck drive during a subsequent winding process. The detuning by different speeds of the surfaces of the contact roller and the bobbin package can also be used at any time during the whole package build-up for controlling the chuck speed.

13 Claims, 4 Drawing Sheets

METHOD AND APPARATUS FOR WINDING A YARN ONTO A BOBBIN TUBE

This invention relates to a method and apparatus for winding a yarn onto a bobbin tube.

As is known, various techniques have been employed for the winding of a yarn onto a bobbin tube. For example, U.S. Pat. No. 4,548,366 and corresponding European Patent 0200234 describes a bobbin winding machine wherein a yarn is delivered from a rotating contact roller onto a bobbin tube mounted on a rotatable chuck. As described, a gap is left open to prevent damage to the first layers of yarns during the beginning of a thread winding formation between the bobbin tube (case) and the contact roller. During the initial phase of winding, this gap slowly fills up and the surface of the bobbin package comes into contact with the contact roller whose speed is set according to the winding-up speed of the yarn. The speed of the bobbin is successively reduced during the filling of the gap in accordance with a predefined speed ramp so as to keep the circumferential speed at the bobbin surface of the bobbin being formed approximately constant. Depending on the type and the properties of the yarn to be wound, deviations from the calculated value of the reduction in speed can occur. Hence, at the time of contact of the bobbin surface after the filling of the gap has occurred, there is a difference in speeds between the surfaces that come into contact with one another. Due to the contact of the bobbin surface and the surface of the contact roller, which roller is attached to a vertical carriage, the contact roller is lifted by the increasingly built bobbin. Depending on the path covered, the carriage movement actuates a microswitch which switches on a control device by means of which the speed of the bobbin can be adapted to the predefined speed of the contact roller.

However, in these known winding machines, a certain amount of time passes until the microswitch is activated by the lifting of the carriage. During this time, the yarns lying at the surface of the bobbin are subject to friction due to the nonsynchronized speed of the surface of the bobbin and of the contact roller or tachometric roller. This can lead to damage to the yarns.

Accordingly, it is an object of the invention to provide a technique for winding a yarn onto a bobbin tube which avoids damage to yarns lying at the surface of a bobbin when brought into contact with a contact roller in a winding machine.

It is another object of the invention to avoid damage to yarns during winding on a winding machine.

It is another object of the invention to synchronize the speeds of a chuck on which a bobbin tube is mounted and a contact roller in a controlled manner to avoid damage to the yarn during winding.

Briefly, the invention provides a method and apparatus for winding yarn onto a bobbin tube.

In accordance with the method, a bobbin tube is mounted on a rotatable chuck (hereinafter referred to as a "peg") which is driven by a first drive motor with the bobbin tube positioned in spaced relation to a periphery of a rotatable contact roller which is driven by a second drive motor in order to define a gap of predetermined size therebetween.

In accordance with the invention, the peg is rotated during an initial phase of the winding of the yarn onto the bobbin tube at a predetermined speed ramp until the bobbin contacts the periphery of the contact roller. In addition, a change of an ascertainable operating parameter of at least one of the peg and the contact roller is sensed in response to the contact of the bobbin with the contact roller. Thereafter, the speed of rotation of the peg is regulated in order to maintain a predefined winding speed.

In accordance with the invention, the operating parameter which is selected for sensing is selected from the group consisting of the speed of the peg, the speed of the contact roller, the pressure force of the contact roller on the bobbin, the torque of the contact roller, the torque of the peg, the power consumption of the drive motor for the peg and the power of consumption of the drive motor for the contact roller.

The apparatus for winding the yarn includes a rotatable peg for receiving a bobbin tube, a drive motor for rotating the peg, a frame, a rotatable contact roller and a drive motor for rotating the contact roller. In addition, the contact roller is slidably mounted in the frame at a point spaced from the peg in order to define a gap therebetween of predetermined size prior to winding of the yarn onto the bobbin tube on the peg.

The apparatus also includes a ramp generator for controlling the speed of the peg during the initial phase of the winding process in accordance with a predetermined speed ramp. A means is also provided for controlling the speed of the peg after contact of the bobbin on the peg with the contact roller. In accordance with the invention, a means is also provided for detecting a change of an ascertainable operating parameter of at least one of the peg and contact roller in response to the contact of the bobbin with the contact roller. This latter means is responsive to the change in the operating parameter in order to activate a first means for controlling the speed of the peg while deactivating the ramp generator.

In accordance with the invention, the speed ramp for a subsequent winding process can be corrected so that the speed of the peg is corrected during the filling of the gap between the contact roller and a fresh bobbin surface.

Use of the apparatus permits the elimination of a microswitch to measure the lifting of the contact roller due to the package formed on the bobbin. The "detuning" of the operating parameter can now be used to initiate the control of the speed of the bobbin. For example, the speed of the peg after contact of the bobbin with the contact roller can be used as the operating parameter for controlling the speed of the bobbin. Alternatively, or in addition to this, it is possible to measure the pressure force of the contact roller on the bobbin surface or the torque or the power consumption of the drive motors of the contact roller or of the peg and to activate the automatic controller of the bobbin peg drive on reaching a predefined threshold value.

It is easily possible to determine even extremely low changes in speed both in the positive as well as the negative direction where the contact roller is driven by an asynchronous drive motor so that in contrast to the activation of the switch, no switch path has to be covered. With simultaneous measurement of the pressure force of the contact roller on the bobbin, it can further be ensured that the control of the speed of the bobbin or the contact roller only starts when a predefined minimum value has been achieved.

These and other objects and advantages of the invention will become more apparent from the following detailed description taken in conjunction with the accompanying drawings wherein.

Figure 3:
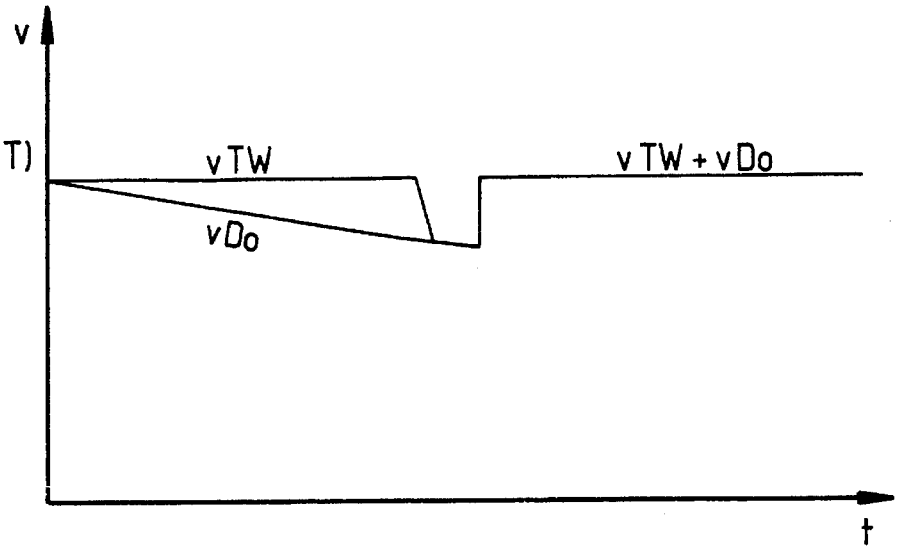
FIG. 3 (PRIOR ART)
Figure 4:
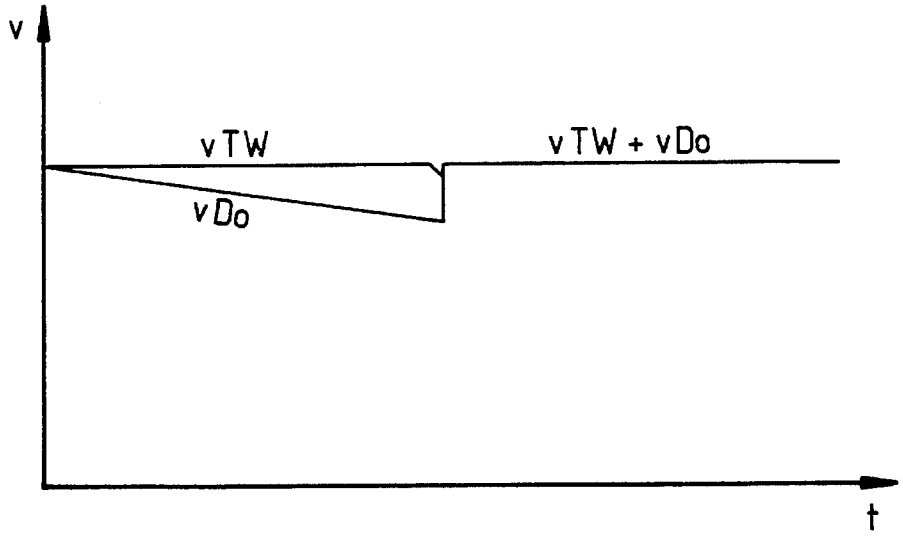
Figure 5:
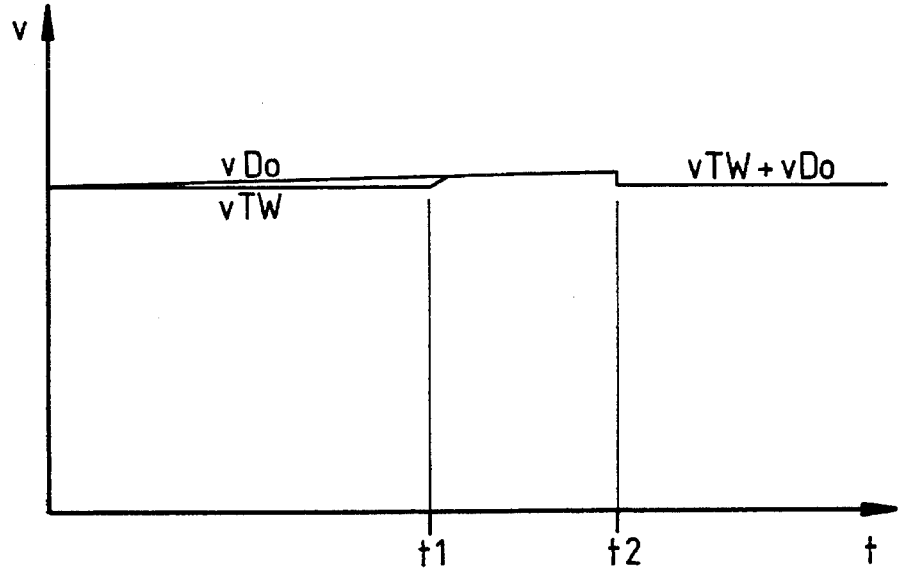
Figure 6:
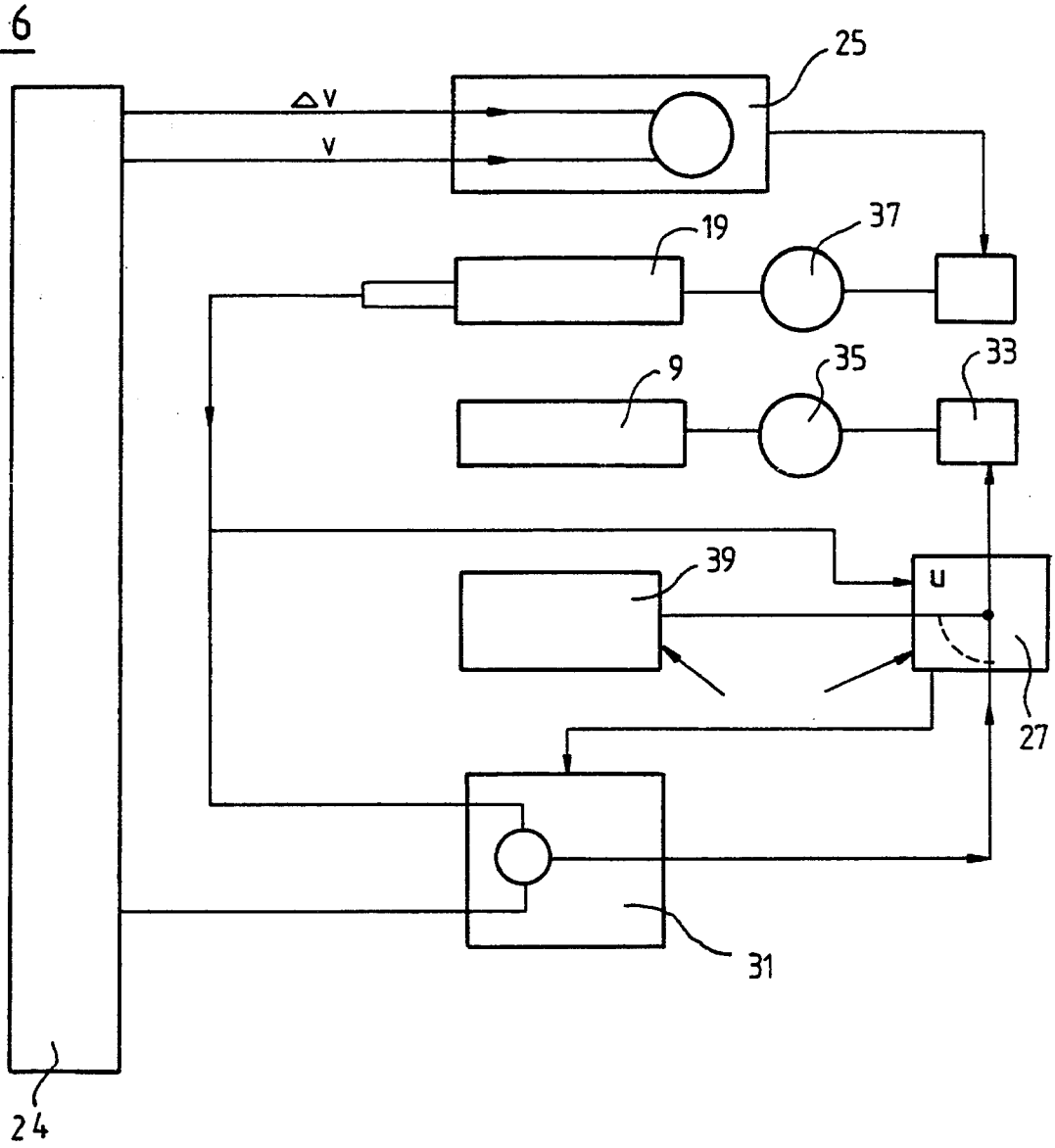
Figure 7:
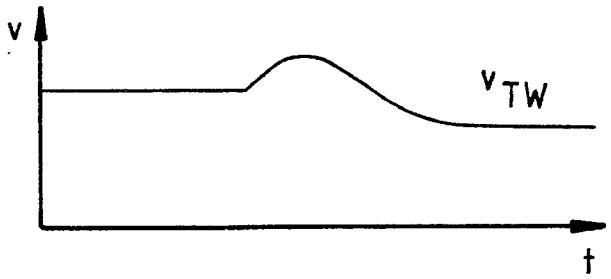
Figure 8:
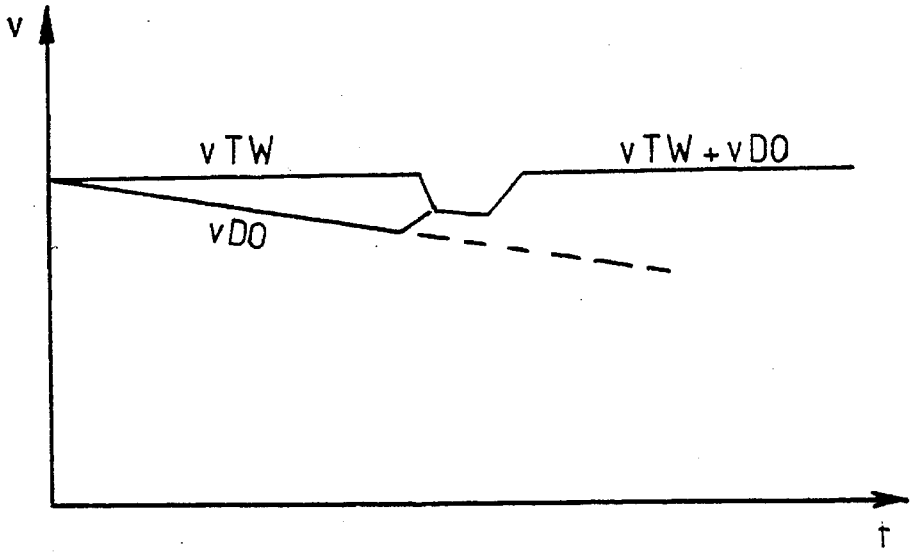
Figure 9:
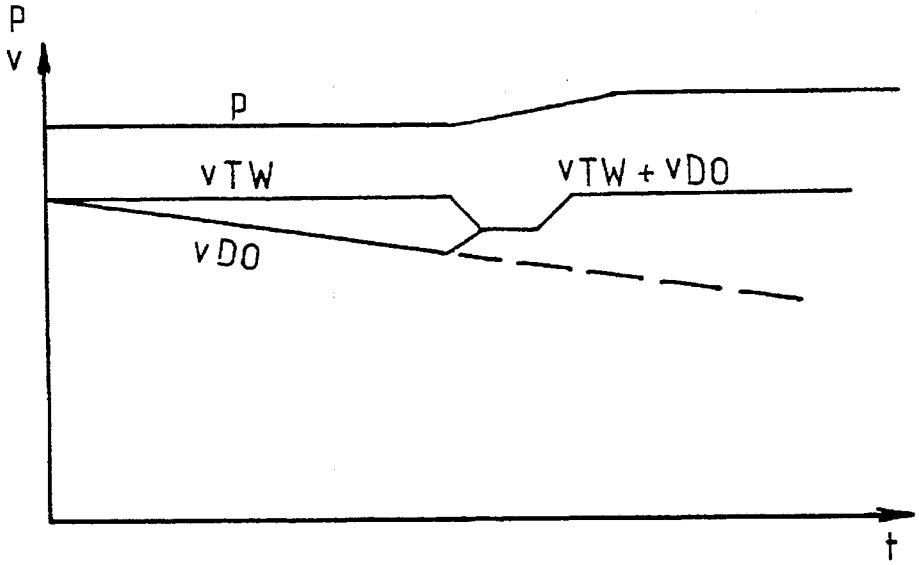
Figure 10:
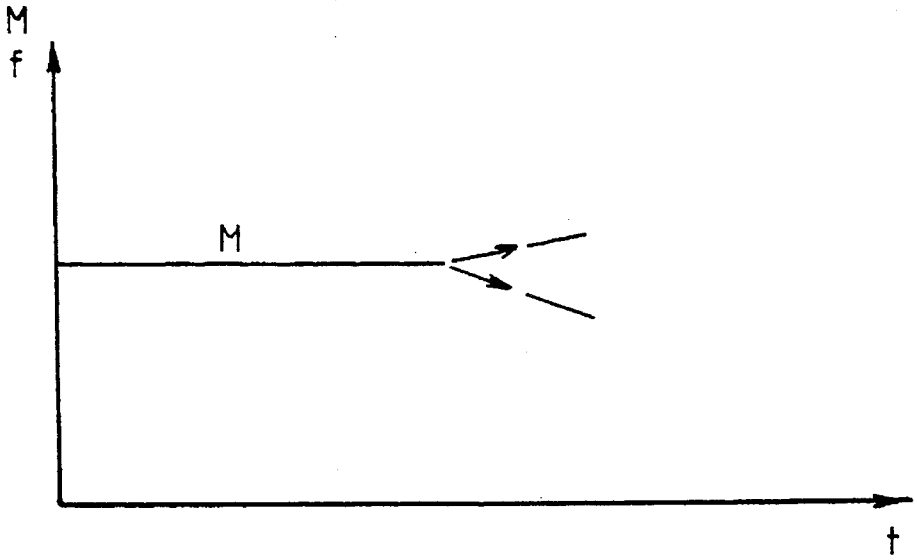

FIG. 3 graphically illustrates the relationship between the bobbin speed relative to the speed of a contact roller in a known bobbin winding machine;

FIG. 4 graphically illustrates the relationship between a too low bobbin speed and a contact roller speed in accordance with the invention;

FIG. 5 graphically illustrates a substantially corrected speed ramp as corrected in accordance with the invention;

FIG. 6 schematically illustrates a circuit diagram for activating a means for regulating the speed of a peg in accordance with the invention;

FIG. 7 graphically illustrates a speed curve of the contact roller before, during and after activation of a chuck drive control by "detuning" of the frequency of the contact roller by a bobbin;

FIG. 8 graphically illustrates the relationship of a bobbin speed that is too low and the detection of a detuning of the peg speed in accordance with the invention;

FIG. 9 graphically illustrates a bobbin speed that is too low relative to the acquisition of a pressing force/load of a contact in accordance with the invention; and FIG. 10 graphically illustrates the torque of the peg drive or the contact roller drive during a run-up-process (start-up) with a deviation of the operating parameter either upwardly or downwardly.

Figure 1:
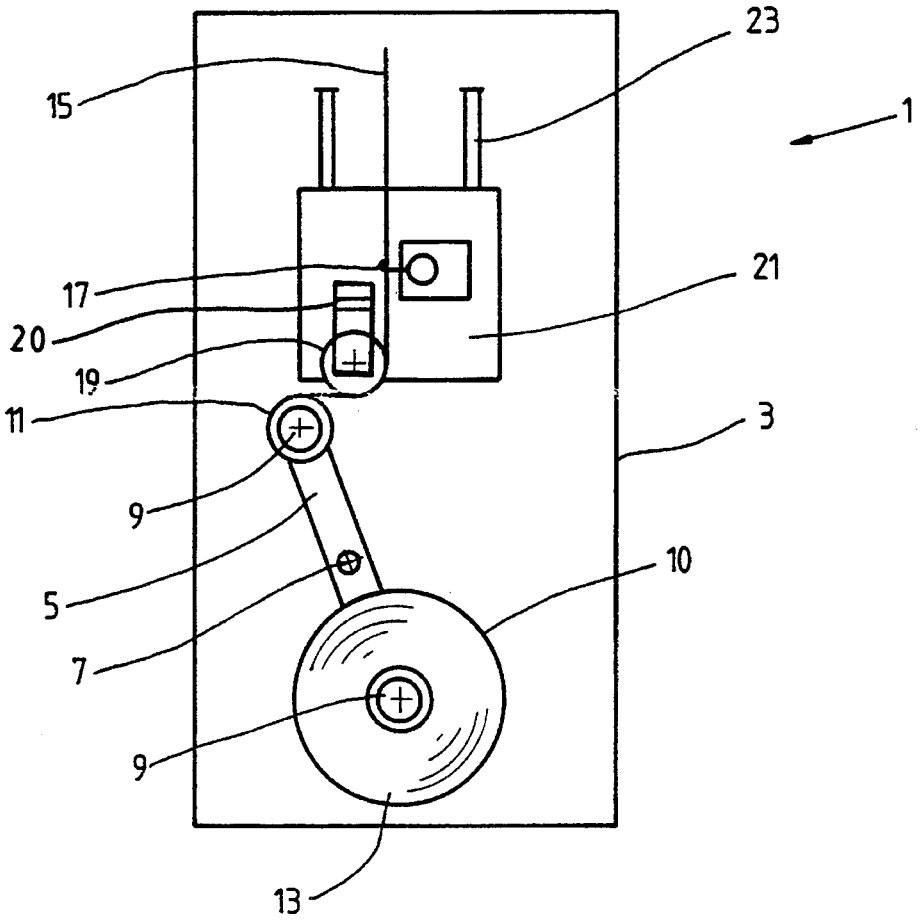
FIG. 1 illustrates a side view of a bobbin winding machine constructed in accordance with the invention.

Referring to FIG. 1, the bobbin winding machine which is capable of operating at a high speed is typically used for synthetic filaments. In order to simplify the following description, only a single yarn course is shown. In reality, up to eight bobbins are situated adjacent to one another, each on a peg in such machines. The arrangements of the machine 1 is equivalent to the known state-of-the-art, as described above in European Patent Specification No. 0200234. FIG. 1, therefore, only shows the elements that are important for a description of the invention.

As shown, the machine 1 has a frame or casing 3 in which a revolver 5 is pivotally mounted about an axle 7. This revolver 5 carries a peg 9 at each end with each peg 9 being sized to receive a bobbin tube (case) 11. In the illustrated embodiment, the lower peg 9 has a package 10 of a full bobbin 13 thereon while the upper bobbin tube 11 has only a very small quantity of yarn wound thereon. This quantity of yarn is hardly visible in FIG. 1.

The machine 1 also has a contact roller 19 slidably mounted in the frame 3 for vertical movement. At the initial point of winding, the peg 9 is mounted relative to the contact roller 19 so that a gap S of predetermined size is disposed between the contact roller 19 and the surface of the bobbin tube 11.

Referring to FIG. 1, the yarn 15 which comes in from above is guided to and fro by a traversing apparatus 17 for winding onto the bobbin tube 11.

Figure 2:
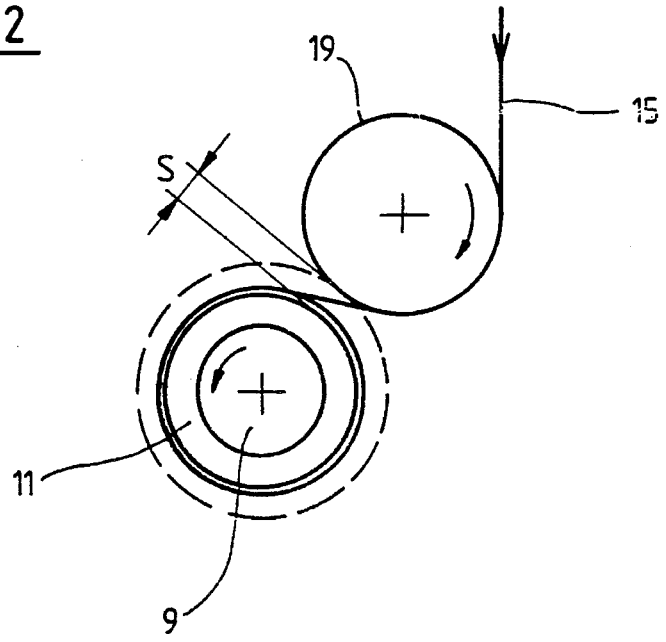
FIG. 2 illustrates an enlarged view of a peg having a bobbin being wound thereon and a contact roller of the winding machine of FIG. 1 at the beginning of a winding operation.

As indicated in FIG. 2, the gap S is filled only after a certain yarn quantity has been wound up on the bobbin tube 11 and eventually disappears. The magnitude of the gap S is preset and depends on the speed of the contact roller 19 and, thus, on the winding speed of the machine 1 as well as the titre and other qualities of the yarn 15 to be wound up.

The contact roller 19 as well as the traversing apparatus 17 are held in a cantilever arm 21 which is vertically displaceable along a guiding means 23. A force measuring means 20, such as a force measuring bearing or a force measuring cell, may be disposed between the contact roller 19 and the cantilever arm 21, by means of which the pressure force of the contact roller 19 on the bobbin package can be measured so that the measured value can be used to activate an automatic controller as described below. An apparatus for measuring the pressure force is known, for example, from EP-A 371 912.

The initial winding up of yarn 15 onto the bobbin tube 11 without contact with the contact roller 19 has the advantage that there is no "milling effect" or friction of the contact roller 19 on the bobbin tube 11 and thus no damage to the outer layers of the yarn 15 wound onto the bobbin tube 11. The time until gap "S" has been filled is determined by a speed ramp calculated in advance, i.e., a speed curve which reduces the speed of the peg 9 during the increase of diameter of the bobbin package 13 to the extent that when gap "S" has been filled mutual contact occurs between the roller 19 and the bobbin package 13, the surface speeds thereof are calculatorily identical. However, this is only theoretically possible due to various parameters such as consistency of yarn 15, titre, and the like.

When, according to the doctrine of U.S. Pat. No. 4,548, 366 and European patent No. 0 200 234, the gap "S" has been filled, the surface of the bobbin package 13 comes into contact with the contact roller 19 and lifts the roller 19 in combination with the cantilever arm 21 until a microswitch (not shown) cooperating with the extension arm 21 switches on an automatic controller which controls the speed of the peg 9 in such a way that the circumferential speed of the contact roller 19 is equivalent to a predefined set value. Until the activation of the microswitch, the bobbin continues to rotate in accordance with the speed ramp, (FIG. 3) as 112 defined by the control unit at speed VD0. The speed VTW of the contact roller 19 drops very rapidly and matches temporarily the speed VD0 prevailing on the surface of the bobbin package, because the drive of the contact roller 19 is carried out by an asynchronous motor. The latter speed, however, is not equivalent to the desired winding-up speed, VTW. Only when the control of the drive of the bobbin 13 has taken full effect by the microswitch will the speed of the bobbin 13 be corrected and controlled to the given nominal speed VTW of contact roller 19.

In FIG. 4, it is either assumed that the pressure force between the contact roller 19 and the package 13 (or packages) will quickly reach a level after contact has been made where a specifically noticeable "detuning" of the contact roller 19 will occur or the pressure force will be determined by means of the force measuring means 20 and the controller (not shown) of the contact roller so that the peg drive will be switched on after reaching a predefined minimum value of control pressure. The speed of the contact roller 19 will accordingly only be reduced very briefly although the speed curve, i.e., the ramp of bobbin 13 has the same course as in the example in accordance with FIG. 3 (state of the art).

In accordance with the invention, the "detuning", i.e., a change in the speed (operating parameter) of the contact roller 19, is detected by an automatic controller after the contact of the package surface with the contact roller 19 and the control of the drive of peg 9 is activated. In this manner, the speed reduction of the peg 9 is not continued according to the predefined ramp, but is interrupted instantly after the "detuning" or after the expiration of a predefinable period of time and the speed VD0 of the peg 9 is instantly increased (see FIG. 4). The time frame during which the two contacting surfaces have different speeds is thus strongly reduced. This leads to the consequence that no uncontrolled torque arises between the surfaces of the contact roller 19 and the bobbin package 13.

Referring to FIG. 5, the time tl of the detuning as well as its direction, (i.e., the bobbin speed, if too high or too low with respect to the contact roller speed) can be instantly noticed by the machine control unit. The amount of the fault can also be detected. If desired, these two values can be used in combination with the previously calculated parameters for the "old" speed ramp for determining a new ramp for the subsequent package formation. It is advantageous to provide the ramp in such a way so as to delay the time tl of a fault as long as possible.

The procedure as relates to automatic control technology and software concerning the change of the speed ramp due to a detuning is shown and explained by reference to a possible "circuit" in accordance with FIG. 6. This "circuit" is "realized" in practice in the software of the machine control unit 24.

During the start, a set point device 25 for the contact roller 19 which is connected to the control unit 24 receives the set values for the winding up speed VTW as well as a correction factor which causes the control of the tangential force, as is described for example in EP-A 182 389. As an asynchronous motor is used as the contact roller drive motor 37, the output signal (frequency F tacho) from the contact roller deviates from the set value. The absolute height of the output frequency (F tacho), however, is unimportant for supervision in a monitoring device 27. After such a delay, during which the contact roller 19 is accelerated to run at the starting speed, a drive motor 35 for the peg is switched on by the control unit 24 and also brought to the starting speed where the yarn insertion (start of winding) can take place.

The circuit includes a ramp generator 39 for controlling the speed of the peg 9 during an initial phase of the winding process in accordance with a predetermined ramp speed. In addition, the means in the form of a controller 31 is provided for controlling the speed of the peg 9 after contact of the bobbin on the peg 9 with the contact roller 19. As indicated, a second means in the form of a monitoring device 27 is connected via a suitable line to the contact roller 19 for detecting a change of an ascertainable operating parameter (e.g. output frequency, F tacho) of the contact roller 19 in response to the contact of the bobbin on the peg 9 with the contact roller 19. In addition, the monitoring device 27 is selectively connected to the ramp generator 39 and controller 31 via a switch (shown schematically) so as to connect one or the other to a frequency converter 33 connected to the drive motor 35 for the peg 9.

The monitoring device 27 switches on the ramp generator 39 during the initial phase of yarn insertion. The generator 39 then supplies an output frequency to the frequency converter 33. The device 27 as well as the ramp signal generator 39, which determines the speed curve of the peg 9, each receives a signal separately when yarn insertion occurs. The controller 31 is deactivated at this time, because the output signal (F tacho) of the contact roller cannot be used for the control.

After the contact of one or several bobbin packages with the contact roller 19, the contact frequency deviates from the starting value. This deviation is detected by the monitoring device 27, which now switches off the ramp generator 39 and activates the controller 31. The controller 31 then reverts the peg speed VDO back to a value which results in a predefined frequency output from the contact roller (the control frequency according to the set frequency for the bobbin speed).

If a pressure force monitoring means is also provided, the controller 31 will only be activated after a set value for the pressure force has been reached. The pressure force p of the contact roller 19 on the bobbin surface can also be used per se as the operating parameter for the initiation of the controller 31 (FIG. 9). Force measuring members may also be built into the bearings of the contact roller 19 for measuring the pressure force p. A force measuring apparatus in a contact roller is known, for example, from U.S. Pat. No. 5,033,685.

Referring to FIG. 9, the speed of the bobbin VDO which would otherwise follow the ramp speed which is indicated in broken line is increased to the speed VTW of the contact roller after the pressure p of the contact roller 19 on the bobbin has been sensed as being increased in value. Subsequently, the speed of the peg and the contact roller can be increased together as indicated.

The deviation from the starting value has to reach such an extent that a substantially slip-free, force-locking connection is achieved between the surfaces of the contact roller 19 and the package 10 on the bobbin 11. Small defective effects need not be taken into account. It is also possible to build in a time delay after determining the deviation so as to ensure that the prerequisites concerning the substantially slip-free, force-locking connection between the surfaces of the contact roller 19 and the bobbin package 10 have been fulfilled in order to obtain from the contact signal a specific measured value corresponding to the actual bobbin speed VDO. Time delay can be avoided if the pressure force is monitored.

The deviation from the starting value $V_{TW}$ can be made upwardly (FIG. 7) or downwardly (not shown). The control frequency can lie above or below the starting frequency or it can be equivalent to the starting frequency.

FIG. 5 provides an explanation for a ramp with delayed detuning, which ramp was set after detection of a malfunction during the previous winding process, the ramp being corrected accordingly. The ramp of the bobbin speed is now substantially flatter than in the previous examples, and at the time tl of contact with the contact roller 19; the difference of the bobbin speed VDO from the contact roller speed VTW is so low that the controller 31 has not yet recognized the difference and the speed VTW of the contact roller 19 is slightly increased by the bobbin 13. A lifting occurs in this case, because the speed VDO of the bobbin 13 was higher at the time of contact with the contact roller 19 than the nominal speed VTW of the contact roller 19. The speed of the contact roller 19 and the speed of the peg 9 now run synchronously, but above the nominal speed of the contact roller 19. At time t2, the deviation of the contact roller speed VTW is so large again that the controller 31 is activated and lowers the speed VDO of the peg 11 until the nominal speed VTW of the contact roller 19 is reached.

As an alternative to the detection of a deviation of the contact roller speed VTW, it is also possible in accordance with FIG. 8 to use a deviation of the peg speed VDO from a set value as an operating parameter for activating the controller 31 after the contact of the contact roller 19 with the bobbin surface. The processing of the deviation occurs analogously to that described above.

As indicated in FIG. 8, the bobbin speed VDO operates during an initial phase in accordance with a ramp speed which would otherwise continue as indicated in broken lines but for the sensing of a change in the operating parameter being monitored. At this time, the speed of the bobbin is corrected so as to be increased to the speed VTW of the contact roller.

In the embodiment of the invention in accordance with FIG. 10, the change (detuning) of the torque M in the drive of the contact roller 19 or in the peg is monitored and used for activating the controller 31. Instead of the torque, it is also possible to use a change (detuning) in the power consumption of the drive motors 35, 37 of the contact roller 19 or the peg 9 as the operating parameter.

The characteristic of the detuning, i.e., the time and the magnitude of the last detuning, can be used for calculating the ramp of a successive winding process. As an alternative to the detection of the detuning of the contact roller speed, it is also possible to detect the detuning of the speed of the peg 9 and to use it for the activation of controller 31.

The invention thus provides a technique in which the speed of the peg on which a bobbin is being wound can be rapidly adjusted to the speed of the contact roller to avoid damage to the yarn being wound onto the bobbin.

The invention further provides a technique for correcting the speed of a rotating peg in dependence on an operating parameter of the peg or the contact roller after contact is made between a bobbin on the peg and the contact roller.

What is Claimed:

1. A method for winding yarn into a bobbin tube, said method comprising the steps of mounting a bobbin tube on a rotatable chuck driven by a first drive motor;

positioning the chuck mounted bobbin tube in spaced relation to a periphery of a rotatable contact roller driven by a second drive motor to define a gap of predetermined size therebetween;

rotating the contact roller while rotating the chuck to wind the delivered yarn onto the bobbin tube to form a bobbin;

rotating the chuck during an initial phase of winding of the yarn onto the bobbin tube at a predetermined speed ramp until the bobbin contacts said periphery of the contact roller;

sensing a change of an ascertainable operating parameter of at least one of the chuck and contact roller in response to said contact of the bobbin with the contact roller; and thereafter changing the speed of rotation of the chuck to maintain a predefined output signal from the contact roller representing a predetermined circumferential speed of the bobbin.

2. A method as set forth in claim 1 wherein said operating parameter is selected from the group consisting of the speed of the chuck, the speed of the contact roller, the pressure force of the contact roller on the bobbin, the torque of the contact roller, the torque of the chuck, the power consumption of the first drive motor and the power consumption of the second drive motor.

3. A method as set forth in claim 1 which further comprises the step of correcting said speed ramp in a subsequent winding process for a second bobbin in dependence on the acquisition of the positive or negative direction and time of said change in said operating parameter.

4. A method as set forth in claim 3 wherein said step of correcting is performed after every new bobbin change.

5. A method as set forth in claim 1 which further comprises the step of sensing a change in said operating parameter from a predetermined set value after contact and correcting the speed of the chuck in response to said change.

6. An apparatus for winding yarn onto a bobbin tube, said apparatus comprising a rotatable chuck for receiving a bobbin tube for winding of yarn thereon to form a bobbin;

a first drive motor for rotating said chuck;

a frame;

a rotatable contact roller for delivering a yarn to a bobbin tube on said chuck, said contact roller being slidably mounted in said frame at a point spaced from said peg to define a gap therebetween of predetermined size;

a second drive motor for rotating said contact roller;

a ramp generator for controlling the speed of said chuck during an initial phase of a winding process in accordance with a predetermined ramp speed;

first means for controlling the speed of said chuck after contact of the bobbin on said chuck with said contact roller; and second means for detecting a change of an ascertainable operating parameter of at least one of the chuck, contact roller, first drive motor and second drive motor in response to said contact of the bobbin with said contact roller, said second means being responsive to said change to activate said first means to control the speed of said chuck while deactivating said ramp generator.

7. An apparatus as set forth in claim 6 wherein said second means is a monitoring device having a switch for selectively connecting one of said ramp generator and said first means to said first drive motor.

8. An apparatus as set forth in claim 6 which further comprises a programmed control unit having a program incorporating said first means and said second means therein.

9. An apparatus as set forth in claim 6 wherein said second means is a force measuring means for measuring the pressure force of said contact roller on the bobbin wound on said chuck, said force measuring means being disposed between said frame and said contact roller.

10. An apparatus as set forth in claim 9 wherein said force measuring means is connected to said first means to deliver a signal to said first means to permit said first means to be activated in response to said second means.

11. An apparatus for winding yarn onto a bobbin tube, said apparatus comprising a rotatable chuck for receiving a bobbin tube for winding of yarn thereon to form a bobbin;

a first drive motor for rotating said chuck;

a frame;

a rotatable contact roller for delivering a yarn to a bobbin tube on said chuck, said contact roller being slidably mounted in said frame at a point spaced from said chuck to define a gap therebetween of predetermined size;

a second drive motor for rotating said contact roller;

a ramp generator for controlling the speed of said chuck during an initial phase of a winding process in accordance with a predetermined ramp speed;

a controller for controlling the speed of said chuck after contact of the bobbin with said contact roller; and a monitoring device for sensing a change in an ascertainable operating parameter of at least one of the chuck, contact roller, first drive motor and second drive motor in response to said contact of the bobbin with said contact roller, said monitoring device being responsive to said change to activate said controller to control the speed of said chuck while deactivating said ramp generator.

12. An apparatus as set forth in claim 11 wherein said monitoring device has a switch for selectively connecting one of said ramp generator and said controller to said first drive motor.

13. An apparatus as set forth in claim 12 which further comprises a frequency convertor connected to and between said monitoring device and said first drive motor.

* * * * *